US009095234B2

(12) United States Patent
Lee et al.

(10) Patent No.: US 9,095,234 B2
(45) Date of Patent: Aug. 4, 2015

(54) FOLDABLE MAT

(71) Applicant: Hui-Chuan Lee, Kaohsiung (TW)

(72) Inventors: Hui-Chuan Lee, Kaohsiung (TW); Yao-Ming Yeh, Miaoli (TW); Yi-Sheng Chen, Taichung (TW); Tyng-Tyng Lin, New Taipei (TW); Yi-An Chen, Hsinchu (TW); Shu-Man Chen, Kaohsiung (TW)

(73) Assignee: Hui-Chuan Lee, Kaohsiung (TW)

( * ) Notice: Subject to any disclaimer, the term of this patent is extended or adjusted under 35 U.S.C. 154(b) by 77 days.

(21) Appl. No.: 14/050,350

(22) Filed: Oct. 10, 2013

(65) Prior Publication Data

US 2015/0104118 A1 Apr. 16, 2015

(51) Int. Cl.
*A47G 27/02* (2006.01)
*B65D 33/00* (2006.01)

(52) U.S. Cl.
CPC ..... *A47G 27/02* (2013.01); *B65D 33/00* (2013.01)

(58) Field of Classification Search
CPC .... A45C 3/10; A45C 2007/0013; A45C 3/00; A45C 7/0077; A45F 4/02; A45F 4/06; A45F 3/04; A47G 9/062; A47G 9/1045; A47G 27/02; B65D 33/00
USPC ..... 383/4, 6, 26; 224/156, 575, 577; 5/417–420, 626, 627
See application file for complete search history.

(56) References Cited

U.S. PATENT DOCUMENTS 3,477,552 A * 11/1969 Goldman ..... 190/2
3,489,194 A * 1/1970 Hoover ..... 383/4
3,818,962 A * 6/1974 Muller-Scherak ..... 383/3
4,154,323 A * 5/1979 Sneider ..... 190/2
4,180,112 A * 12/1979 Bovet ..... 383/4
4,180,114 A * 12/1979 Katz ..... 224/153
4,188,988 A * 2/1980 Agyagos ..... 383/4
4,375,111 A * 3/1983 Hall ..... 5/419
4,466,516 A * 8/1984 Sicoli et al. ..... 190/2
4,516,668 A * 5/1985 Grayek ..... 190/2
4,604,765 A * 8/1986 Schultz ..... 5/413 AM
4,723,300 A * 2/1988 Aranow ..... 383/4
4,777,992 A * 10/1988 Olger ..... 108/90
4,822,177 A * 4/1989 Arend ..... 383/4
4,886,150 A * 12/1989 Fitzsimmons ..... 190/1
4,949,401 A * 8/1990 Kimsey, Jr. ..... 2/102
4,984,906 A * 1/1991 Little ..... 383/4
5,048,975 A * 9/1991 Holbrook ..... 383/4
5,110,219 A * 5/1992 Lopes ..... 383/4
5,120,108 A * 6/1992 Watson et al. ..... 297/188.2
5,179,741 A * 1/1993 Book ..... 5/417
5,187,823 A * 2/1993 Ferguson et al. ..... 5/417
5,370,460 A * 12/1994 Nelson ..... 383/4
5,390,381 A * 2/1995 LaMantia ..... 5/417
5,413,198 A * 5/1995 Ferris ..... 190/1
5,425,449 A * 6/1995 Boorady ..... 206/287.1
5,454,643 A * 10/1995 Sullivan ..... 383/4
5,454,644 A * 10/1995 Augustin ..... 383/120
5,467,487 A * 11/1995 Sicard ..... 5/419
5,480,229 A * 1/1996 Thangsrirojkul ..... 383/4
5,482,374 A * 1/1996 Buhyoff ..... 383/4
5,518,313 A * 5/1996 McAdam ..... 383/4

(Continued)

*Primary Examiner* — Jes F Pascua
*Assistant Examiner* — Peter Helvey

(57) ABSTRACT

A foldable, rectangular mat having two sides, a front end, and a rear end is provided with seams, panels, hook and loop fasteners, snap fasteners, and through holes. The mat is configured to fold into a bag for carrying effects or thereafter unfold into a flattened one for allowing person(s) to sit or lie on.

1 Claim, 8 Drawing Sheets

(56) References Cited

U.S. PATENT DOCUMENTS

| | | | | | |
|---|---|---|---|---|---|
| 5,533,653 | A * | 7/1996 | Kaufman | 224/577 |
| 5,588,749 | A * | 12/1996 | Ishikawa | 383/4 |
| 5,618,110 | A * | 4/1997 | Sullivan | 383/4 |
| 5,629,071 | A * | 5/1997 | Feldman | 428/192 |
| 5,730,529 | A * | 3/1998 | Fritz et al. | 383/4 |
| 5,737,785 | A * | 4/1998 | Casey | 5/419 |
| 5,819,343 | A * | 10/1998 | Zampirri et al. | 5/417 |
| 6,061,849 | A * | 5/2000 | Seals | 5/417 |
| 6,067,803 | A * | 5/2000 | Wolsey et al. | 62/60 |
| 6,074,093 | A * | 6/2000 | Anderson | 383/4 |
| 6,129,452 | A * | 10/2000 | Hakulin | 383/4 |
| 6,135,635 | A * | 10/2000 | Miller et al. | 383/2 |
| 6,186,380 | B1 * | 2/2001 | Grounds | 224/156 |
| 6,192,536 | B1 * | 2/2001 | Connors | 5/417 |
| 6,276,828 | B1 * | 8/2001 | Otley et al. | 383/4 |
| 6,393,638 | B1 * | 5/2002 | MacColl | 5/419 |
| 6,408,462 | B1 * | 6/2002 | Moore | 5/417 |
| 6,663,459 | B2 * | 12/2003 | Ostolaza | 446/75 |
| 6,721,973 | B1 * | 4/2004 | Cristiano | 5/417 |
| 6,751,816 | B1 * | 6/2004 | Wechsler | 5/417 |
| 6,793,991 | B2 * | 9/2004 | Thuma et al. | 428/34.1 |
| 7,076,816 | B1 * | 7/2006 | Nielsen et al. | 5/417 |
| 7,111,343 | B1 * | 9/2006 | Bates | 5/485 |
| 7,222,705 | B1 * | 5/2007 | Guza | 190/1 |
| 7,600,619 | B2 * | 10/2009 | Sapyta | 190/107 |
| 7,614,100 | B1 * | 11/2009 | Barrington et al. | 5/420 |
| 7,980,761 | B2 * | 7/2011 | Fultcher et al. | 383/4 |
| 8,122,538 | B2 * | 2/2012 | McBrearty | 5/417 |
| 8,225,934 | B1 * | 7/2012 | Malcolm et al. | 206/541 |
| 8,439,174 | B1 * | 5/2013 | Miranda | 190/2 |
| 2003/0221924 | A1 * | 12/2003 | Tong | 190/107 |
| 2006/0177154 | A1 * | 8/2006 | Morrissey, Jr. | 383/4 |
| 2008/0131033 | A1 * | 6/2008 | Grosser | 383/4 |
| 2009/0028466 | A1 * | 1/2009 | Bailey | 383/4 |
| 2009/0255060 | A1 * | 10/2009 | Biggs | 5/417 |
| 2010/0008601 | A1 * | 1/2010 | Prudencio | 383/4 |
| 2010/0314424 | A1 * | 12/2010 | Liu et al. | 224/257 |
| 2011/0013856 | A1 * | 1/2011 | Gilbert | 383/4 |
| 2012/0063702 | A1 * | 3/2012 | Daugherty | 383/4 |
| 2012/0128268 | A1 * | 5/2012 | Fazackerley et al. | 383/4 |
| 2012/0128269 | A1 * | 5/2012 | Rittenour | 383/4 |
| 2012/0237141 | A1 * | 9/2012 | Muir | 383/4 |
| 2013/0016922 | A1 * | 1/2013 | Leon | 383/4 |
| 2014/0023295 | A1 * | 1/2014 | Wagner | 383/4 |

* cited by examiner

FOLDABLE MAT

BACKGROUND OF THE INVENTION

1. Field of the Invention

The invention relates to folding structures and more particularly to a mat adapted to fold into a bag for carrying effects or thereafter unfold into a flattened one for allowing person(s) to sit or lie on.

2. Description of Related Art

A conventional foldable, wooden pad comprises a plurality of foldable panels and a center panel, the panels being arranged side by side along their lengths when unfolded parallel to their length; at least one backing upon the bottom surface of each panel, the at least one backing having at least one layer, and the at least one backing hingedly connecting the panels upon their longitudinal edges. The foldable panels may be pivoted upon the backing into an overlying position upon the center panel for storage. The outer edges of the two foldable panels lying in proximity with an edge of the center panel when folded into the storage condition. The backing allows pivoting of the foldable panels upon the center panel where their edges abut during usage in a flattened usable condition. The backing functions as a hinge to allow folding of the panels into a stackable position during not in use and unfolding into a flattened position for placement upon a surface during usage.

Notwithstanding the prior foldable pad, the invention is neither taught nor rendered obvious thereby.

SUMMARY OF THE INVENTION

It is therefore one object of the invention to provide a foldable, rectangular mat having two sides, a front end, and a rear end, comprising a first seam disposed along a transverse, central line; a second seam, a fourth seam, a third seam, and a fifth seam disposed longitudinally from right to left in an intermediate portion of the mat and being perpendicular to the first seam; front and rear sixth seams disposed transversely equally spaced from the first seam; front and rear seventh seams disposed transversely adjacent to front and rear ends of the mat respectively; a first panel defined by the rear sixth seam, the second seam, the rear seventh seam, and the right side of the mat; a second panel defined by the rear seventh seam, the rear end of the mat, the right side of the mat, and the second seam; a third panel defined by the first seam, the second seam, the rear sixth seam, and the right side of the mat; a fourth panel defined by the front seventh seam, the second seam, the front sixth seam, and the right side of the mat; a fifth panel defined by the rear sixth seam, the fourth seam, the rear seventh seam, and the second seam; a sixth panel defined by the front seventh seam, the third seam, the front sixth seam, and the fourth seam; a seventh panel defined by the rear sixth seam, the third seam, the rear seventh seam, and the fourth seam; an eighth panel defined by the front seventh seam, the fifth seam, the front sixth seam, and the third seam; a ninth panel defined by the front end of the mat, the left side of the mat, the front seventh seam, and the fifth seam; a tenth panel defined by the front seventh seam, the left side of the mat, the front sixth seam, and the fifth seam; an eleventh panel defined by the front sixth seam, the left side of the mat, the first seam, the fifth seam; a twelfth panel defined by the rear sixth seam, the left side of the mat, the rear seventh seam, and the fifth seam; a plurality of hook and loop fasteners disposed adjacent to the front and rear ends of the mat respectively; a plurality of male halves of a plurality of snap fasteners disposed on the sixth panel, the seventh panel, the eighth panel, the ninth panel, and the eleventh panel respectively; a plurality of female halves of the plurality of snap fasteners disposed on the second panel, the third panel, the fifth panel, the sixth panel, and the eighth panel respectively; and a plurality of through holes disposed on the first panel, the fourth panel, the tenth panel, and the twelfth panel respectively.

The above and other objects, features and advantages of the invention will become apparent from the following detailed description taken with the accompanying drawings.

DETAILED DESCRIPTION OF THE INVENTION

Figure 1:
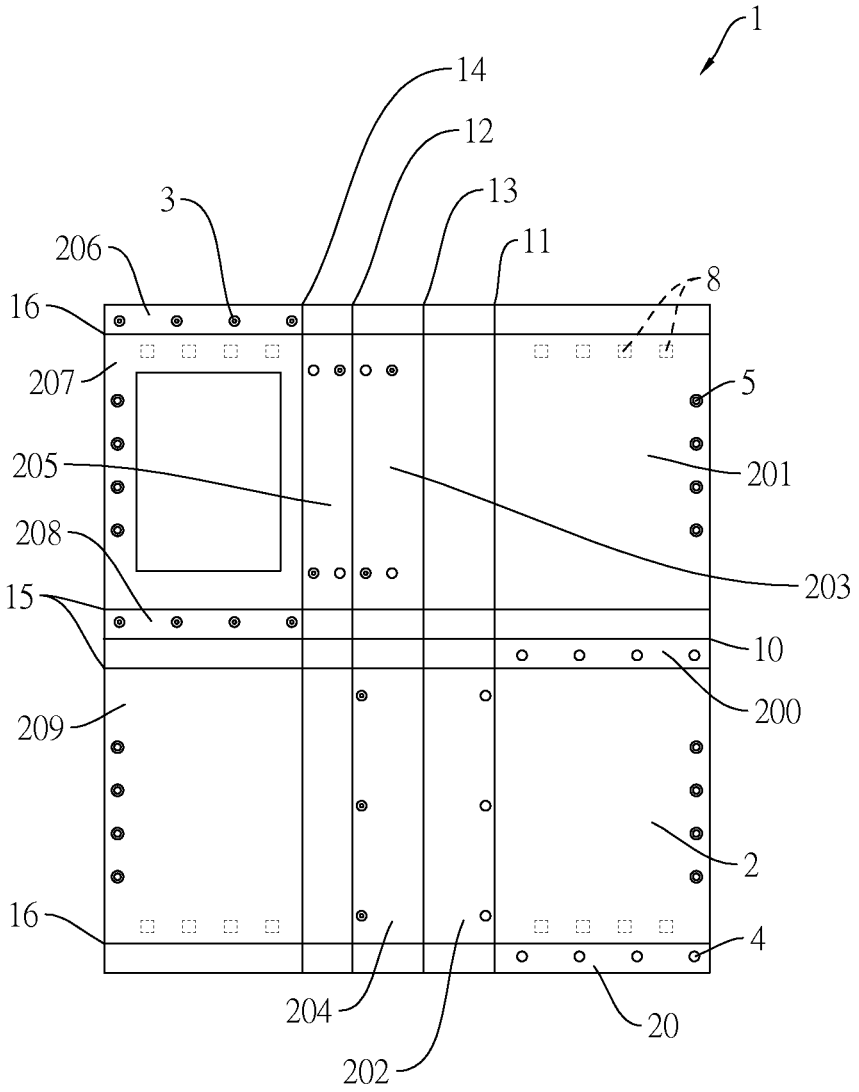
FIG. 1 is a top plan view of a foldable mat according to a first preferred embodiment of the invention.

Referring to FIG. 1, a foldable, rectangular mat 1 in accordance with a first preferred embodiment of the invention comprises the following components as discussed in detail below.

A first seam 10 is provided along a transverse, central line. A second seam 11, a fourth seam 13, a third seam 12, and a fifth seam 14 are provided longitudinally from right to left in an intermediate portion and perpendicular to the first seam 10. Two sixth seams 15 are provided transversely equally spaced from the first seam 10 respectively. Two seventh seams 16 are provided transversely adjacent to front and rear ends respectively. A first panel 2 is defined by the rear sixth seam 15, the second seam 11, the rear seventh seam 16, and a portion of right side. A second panel 20 is defined by the rear seventh seam 16, a rear edge, another portion of right side, and the second seam 11. A third panel 200 is defined by the first seam 10, the second seam 11, the rear sixth seam 15, and another portion of right side. A fourth panel 201 is defined by the front seventh seam 16, the second seam 11, the front sixth seam 15, and another portion of right side. A fifth panel 202 is defined by the rear sixth seam 15, the fourth seam 13, the rear seventh seam 16, and the second seam 11. A sixth panel 203 is defined by the front seventh seam 16, the third seam 12, the front sixth seam 15, and the fourth seam 13. A seventh panel 204 is defined by the rear sixth seam 15, the third seam 12, the rear seventh seam 16, and the fourth seam 13. An eighth panel 205 is defined by the front seventh seam 16, the fifth seam 14, the front sixth seam 15, and the third seam 12. A ninth panel 206 is defined by a portion of front edge, a portion of left side, the front seventh seam 16, and the fifth seam 14. A tenth panel 207 is defined by the front seventh seam 16, another portion of left side, the front sixth seam 15, and the fifth seam 14. An eleventh panel 208 is defined by the front sixth seam 15, another of left side, the first seam 10, the fifth seam 14. A twelfth panel 209 is defined by the rear sixth seam 15, another portion of left side, the rear seventh seam 16, and the fifth seam 14.

A plurality of hook and loop fasteners 8 are formed adjacent to front and rear edges. A plurality of male halves 3 of a plurality of snap fasteners are provided on the sixth panel 203, the seventh panel 204, the eighth panel 205, the ninth panel 206, and the eleventh panel 208 respectively. A plurality of female halves 4 of a plurality of snap fasteners are provided on the second panel 20, the third panel 200, the fifth panel 202, the sixth panel 203, and the eighth panel 205 respectively. A plurality of through holes 5 are provided on the first panel 2, the fourth panel 201, the tenth panel 207, and the twelfth panel 209 respectively.

Figure 2:
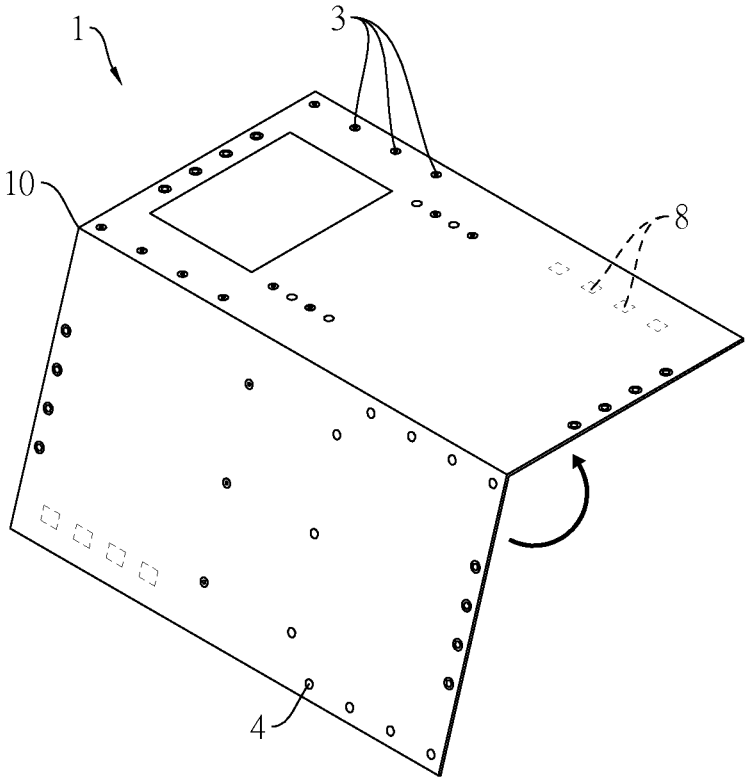
FIGS. 2 to 6 are perspective views showing steps of folding the mat into the main portion of a bag.
Figure 3:
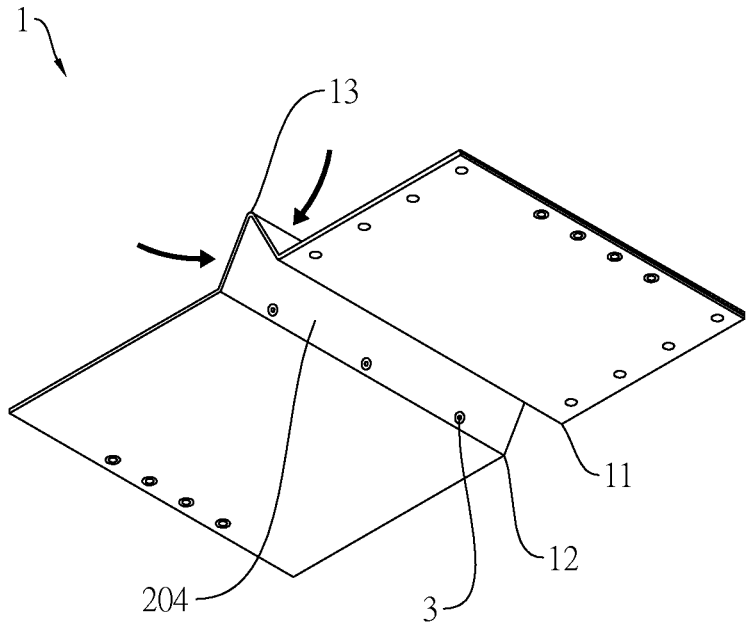
Figure 4:
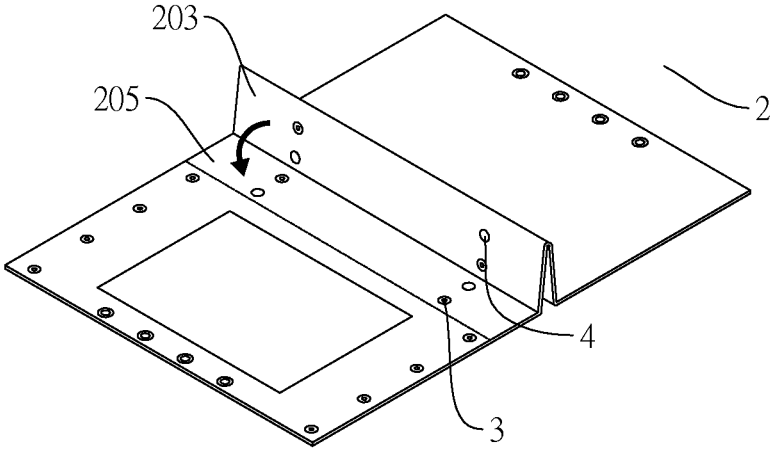
Figure 5:
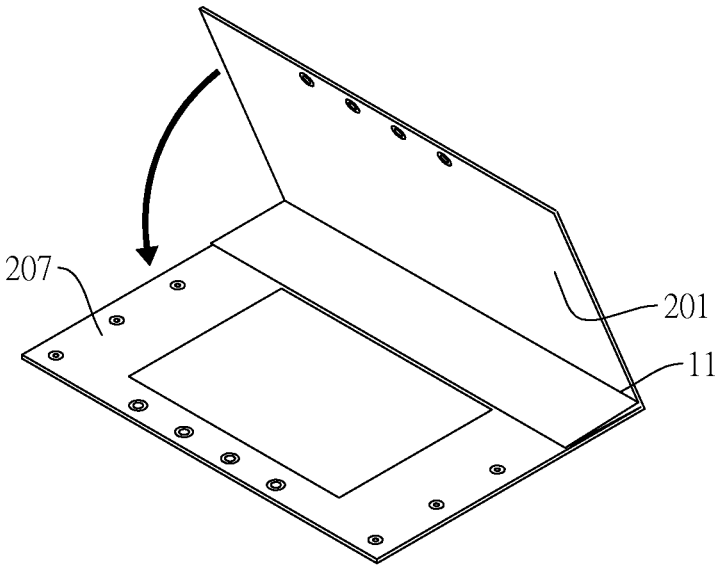
Figure 6:
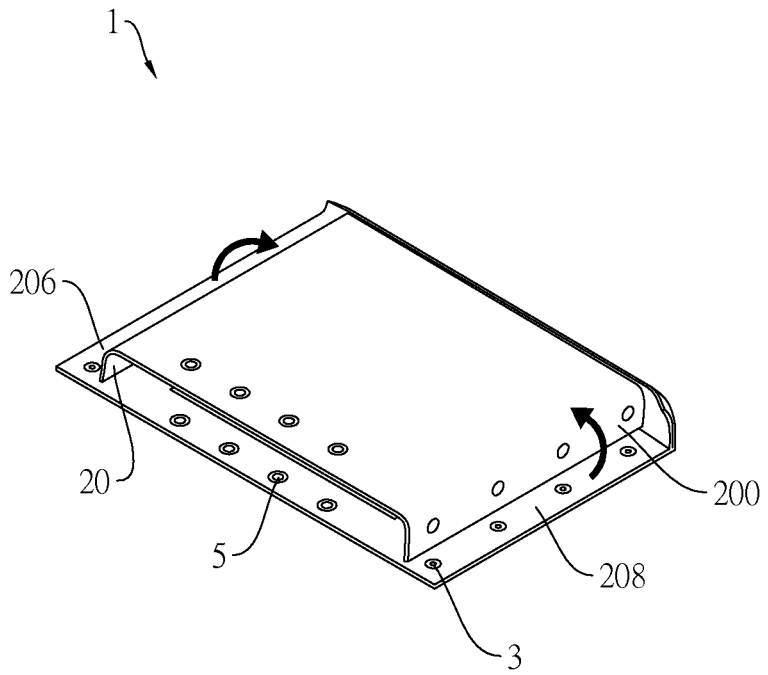
Figure 7:
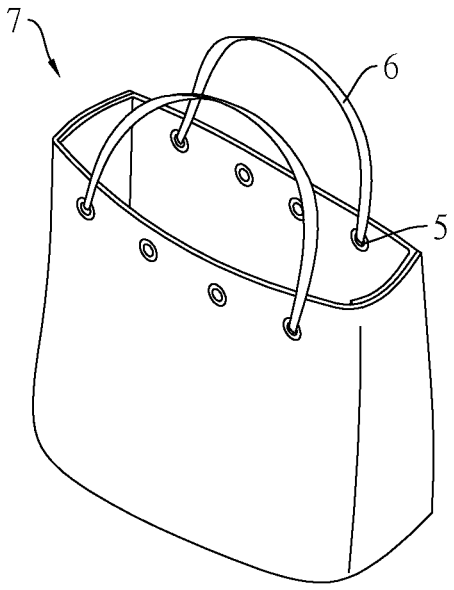
FIG. 7 is a bag having the main portion formed by folding the mat.

Referring to FIGS. 2 to 7, in a folding operation, a person may fold the mat 1 in half along the first seam 10 (see FIG. 2). Next, the person may pull up the fourth seam 13 to form a gable having two lower edges represented by the second and third seams 11, 12 respectively with the male halves 3 of the snap fasteners on the seventh panel 204 and the female halves 4 of the snap fasteners on the fifth panel 202 being fastened together (see FIG. 3). Next, the person fasten the male and female halves 3, 4 of the snap fasteners on the sixth panel 203 and the female and male halves 4, 3 of the snap fasteners on the eighth panel 205 together by snapping (see FIG. 4). Next, the person may fold the fourth panel 201 over the tenth panel 207 along the second seam 11 (see FIG. 5). Next, the person may fold the ninth panel 206 over the second panel 20 and fold the eleventh panel 208 over the third panel 200 respectively to fasten the male halves 3 of the snap fasteners and the female halves 4 of the snap fasteners together (see FIG. 6). Finally, the person may insert two loops 6 through the through holes 5 and tie a knot at each of two ends of the loop 6. As a result, a bag 7 is formed (see FIG. 7).

Figure 8:
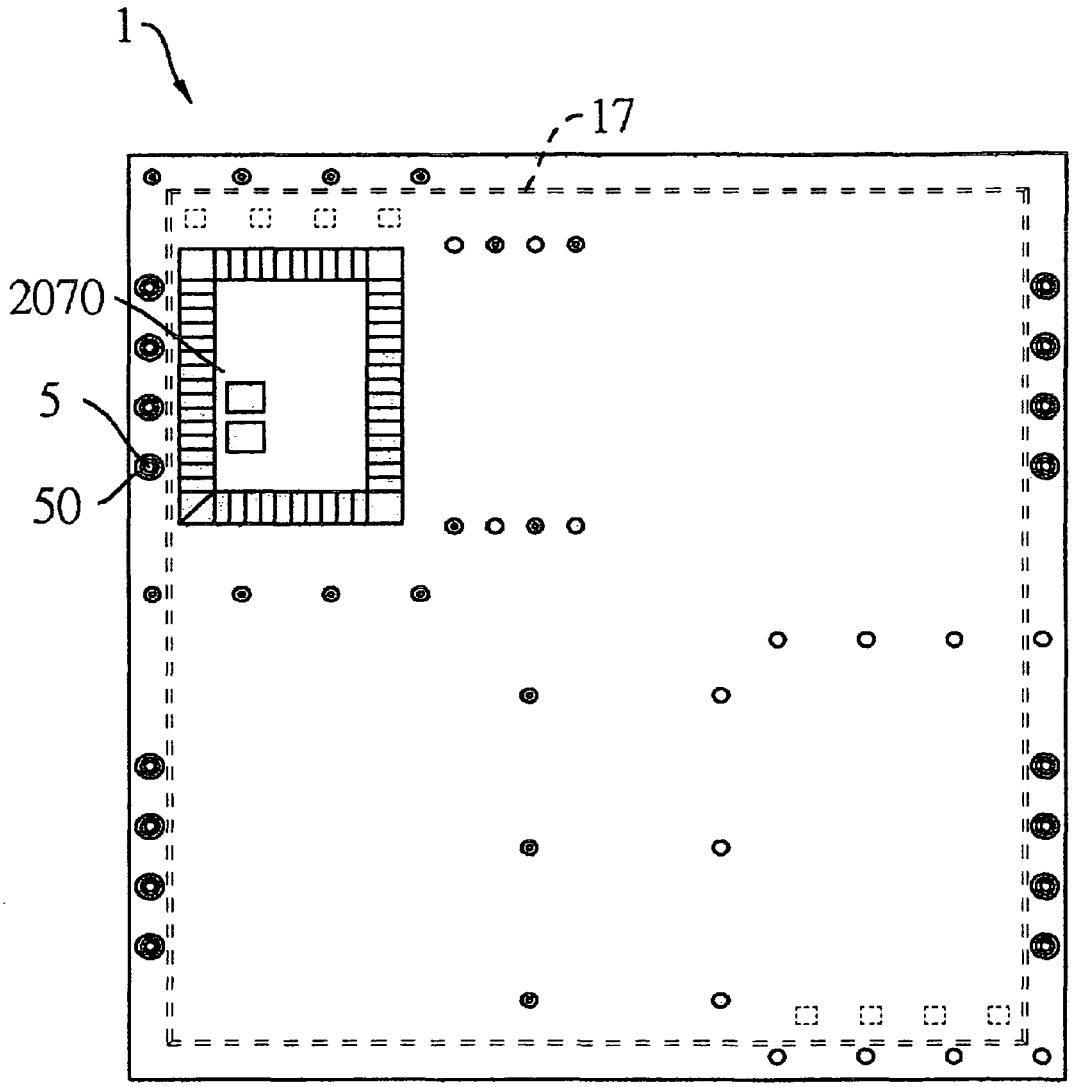
FIG. 8 is a top plan view of a foldable mat according to a second preferred embodiment of the invention.

Referring to FIG. 8, a foldable mat 1 in accordance with a second preferred embodiment of the invention is shown. The characteristics of the second preferred embodiment are substantially the same as that of the first preferred embodiment except the following: A closed, flexible metal wire 17 is provided along four edges of the rectangular mat 1. Further, a metal ring 50 is provided around each through hole 5. Above arrangement aims to increase weight of the mat 1 so that it is difficult of blowing the flattened mat 1 on the ground in outdoors. Furthermore, a transparent layer 2070 with a game printed thereunder is formed on a top surface. Thus, people may play the game in outdoors after unfolding the mat 1 and sitting on the mat 1.

While the invention has been described in terms of preferred embodiments, those skilled in the art will recognize that the invention can be practiced with modifications within the spirit and scope of the appended claims.

What is claimed is:

1. A foldable, rectangular mat having two sides, a front end, and a rear end, comprising:

a first seam disposed along a transverse, central line;

a second seam, a fourth seam, a third seam, and a fifth seam disposed longitudinally from right to left in an intermediate portion of the mat and being perpendicular to the first seam;

front and rear sixth seams disposed transversely equally spaced from the first seam;

front and rear seventh seams disposed transversely adjacent to front and rear ends of the mat respectively;

a first panel defined by the rear sixth seam, the second seam, the rear seventh seam, and the right side of the mat;

a second panel defined by the rear seventh seam, the rear end of the mat, the right side of the mat, and the second seam;

a third panel defined by the first seam, the second seam, the rear sixth seam, and the right side of the mat;

a fourth panel defined by the front seventh seam, the second seam, the front sixth seam, and the right side of the mat;

a fifth panel defined by the rear sixth seam, the fourth seam, the rear seventh seam, and the second seam;

a sixth panel defined by the front seventh seam, the third seam, the front sixth seam, and the fourth seam;

a seventh panel defined by the rear sixth seam, the third seam, the rear seventh seam, and the fourth seam;

an eighth panel defined by the front seventh seam, the fifth seam, the front sixth seam, and the third seam;

a ninth panel defined by the front end of the mat, the left side of the mat, the front seventh seam, and the fifth seam;

a tenth panel defined by the front seventh seam, the left side of the mat, the front sixth seam, and the fifth seam;

an eleventh panel defined by the front sixth seam, the left side of the mat, the first seam, the fifth seam;

a twelfth panel defined by the rear sixth seam, the left side of the mat, the rear seventh seam, and the fifth seam;

a plurality of hook and loop fasteners disposed adjacent to the front and rear ends of the mat respectively;

a plurality of male halves of a plurality of snap fasteners disposed on the sixth panel, the seventh panel, the eighth panel, the ninth panel, and the eleventh panel respectively;

a plurality of female halves of the plurality of snap fasteners disposed on the second panel, the third panel, the fifth panel, the sixth panel, and the eighth panel respectively; and a plurality of through holes disposed on the first panel, the fourth panel, the tenth panel, and the twelfth panel respectively.

* * * * *